United States Patent [19]

Makar et al.

[11] Patent Number: 5,065,290

[45] Date of Patent: Nov. 12, 1991

[54] ILLUMINATED DISPLAY

[76] Inventors: Marko Makar, 7-7883 Knight Street, Vancouver, British Columbia V5P 2X5, Canada; Michael Makar, 8566-164th Street, Surrey, British Columbia V3S 3W9, Canada

[21] Appl. No.: 310,342

[22] Filed: Feb. 14, 1989

[51] Int. Cl.[5] ..... A47B 97/00

[52] U.S. Cl. ..... 362/132; 362/253; 362/800; 362/191; 248/220.4

[58] Field of Search ..... 362/253, 191, 183, 132, 362/8.06, 147, 307, 800, 432; 248/220.4, 221.1, 221.2

[56] References Cited

U.S. PATENT DOCUMENTS

| | | | |
|---|---|---|---|
| 2,096,886 | 10/1982 | Guest | 248/220.4 |
| 4,563,727 | 1/1986 | Curiel | 362/183 |
| 4,747,025 | 5/1988 | Barton | 362/370 |
| 4,779,175 | 10/1988 | Cherneck | 362/287 |
| 4,802,074 | 1/1989 | Puschkarski | 362/287 |
| 4,821,162 | 4/1989 | Ellis | 362/147 |
| 4,827,390 | 5/1989 | Laske | 362/287 |

*Primary Examiner*—Ira S. Lazarus

*Assistant Examiner*—D. M. Cox

[57] ABSTRACT

An illuminated display to be received on a perforate board to receive packages. There is a support of an electrically conducting material to be received in perforations in the board. The support can be connected to a source of electricity and an illuminator is attached to the support in electrical contact with the source of electricity. A package is carried by the support. Wares are attached to the package. An illuminated display having a base to be received on a pair of electrically conducting members is also disclosed. A pair of contacts, one to make electrical contact with each electrically conducting member are provided and a circuit is formed on the base. An illuminator on the base is in electrical contact with the circuit. Completion of the circuit by the pair of contacts lights the illuminator. A display having a support card to be received on a pair of electrical conductors is disclosed. Separate contacts on the card to make contact one with each conductor. A circuit on the card joins the separate contacts. An illuminator is in the circuit so that the separate contacts on the card can contact the conductors to complete the circuit to light the illuminator.

13 Claims, 3 Drawing Sheets

20
24
18
16
24

24
20
22
24
21
18
18
24
24

24
20
22
24
21
18
18
16
24
24

24
24
22
18
18
16
15
24
24
14
12
10

ILLUMINATED DISPLAY

FIELD OF THE INVENTION

This invention relates to an illuminated display and finds particular use in retail outlets.

In retailing it is desirable that attention be directed to a product if that product is to be sold. In modern retailing there are huge numbers of products sold and, increasingly, advertising depends not on a balanced account of the advantages of a particular product but a means of attracting the shoppers' attention. Shopping by whim is a major phenomenon in modern shopping.

DESCRIPTION OF THE PRIOR ART

It is known to illuminate cards, typically using light emitting diodes (LEDs) because LEDs are now so easily and cheaply available and can be made so small. Furthermore, using printed circuit techniques it is easy to apply the appropriate circuitry to a card. Examples of illuminated greeting cards using these techniques U.S. Pat. Nos. 4,363,081 to Wilbur and 4,286,399 to Funashashi et al. Dell, in U.S. Pat. No. 3,034,756 teaches an illuminated display device.

In modern retailing, the use of so-called peg board, which is board formed with large numbers of regularly spaced perforations, is well-known. The perforations provide a convenient means of attaching prongs by engaging the prongs in the openings, and then suspending the packages to be sold from the prongs.

There is no system known to applicant whereby attention can be directed to a product displayed on a pegboard in a store, by the use of flashing lights, either an incandescent light or an LED.

SUMMARY OF THE INVENTION

Accordingly, in a first aspect, the present invention is an illuminated display to be received on a perforate board to receive packages and comprising:

a support of an electrically conducting material to be received in perforations in the board;

means to connect the support to a source of electricity; and illumination means attached to the support in electrical contact with the means to connect the support to a source of electricity.

In a further aspect the present invention is an illuminated display comprising:

a base to be received on an electrically conducting members;

a pair of contacts, one to make electrical contact with each electrically conducting member;

a circuit formed on the base;

illumination means on the base in electrical contact with the circuit, whereby completion of the circuit by the pair of contacts lights the illumination means.

DESCRIPTION OF THE DRAWINGS

Aspects of the present invention are illustrated merely by way of example, in the accompanying drawings in which.

DESCRIPTION OF THE PREFERRED EMBODIMENTS

Figures 1, 2, 3, 4:
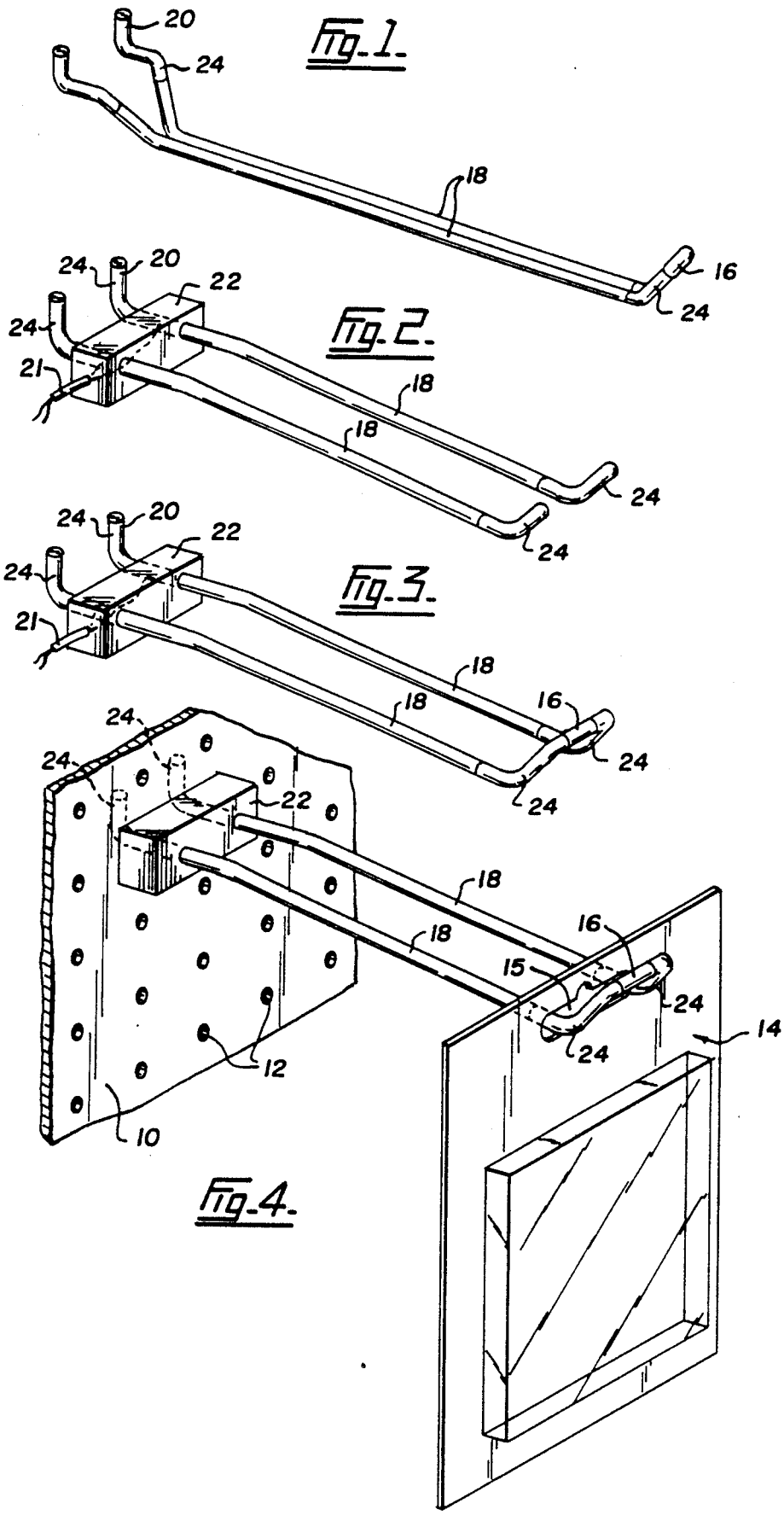
FIG. 1 is a perspective view of a first embodiment of the present invention.
FIG. 2 is a perspective view of a further embodiment.
FIG. 3 is a perspective view of a further embodiment.
FIG. 4 illustrates the embodiment of FIG. 3 in use.
Figure 5:
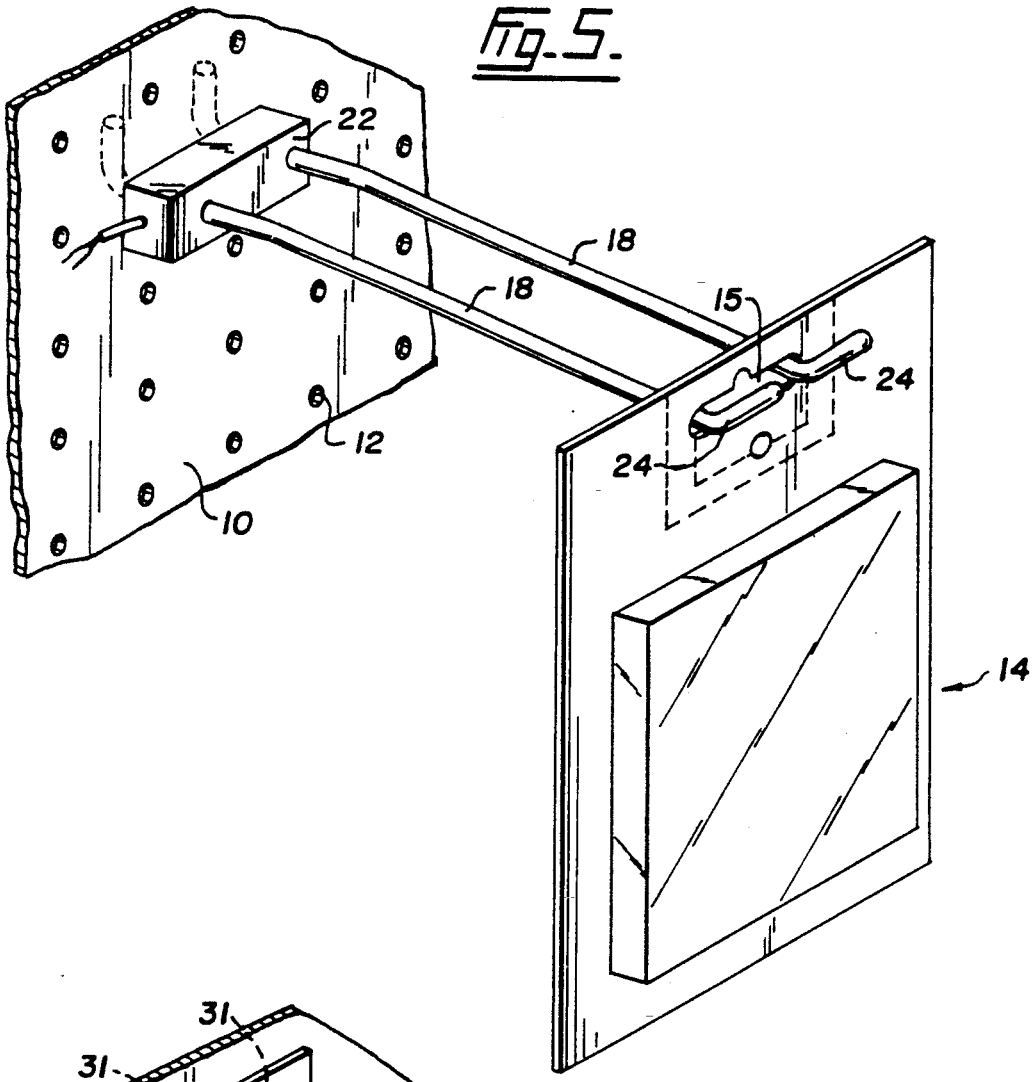
FIGS. 5 and 6 illustrate the use of the embodiments of FIGS. 1 and 2.

FIGS. 1 to 6 all show aspects of an illuminated display to be received on a board 10 having perforations 12, shown in FIG. 4, to receive packages 14, as shown in FIGS. 4 and 5. The packages 14 include an opening 15.

The embodiments of FIGS. 1 to 5 comprise a support made up of prongs 18 of an electrically conducting material which are formed at their inner ends with upwardly extending portions 20 that can be hooked through the perforations 12 of the perforate board 10 to be located in the board. This arrangement is conventional. As shown particularly in FIGS. 2 to 4 the prongs 18 extend outwardly and downwardly from the board 10. There are LEDs 16 attached to the distal end of the prongs 18. There are means to connect the prongs 18 to a source of electricity as shown particularly in FIGS. 2 and 6 where leads 21 extend through a non-conducting member 22, which is attached to the prongs 18 to abut the board 10, to the electrically conducting prongs 18. LED 16 is attached to the prongs 18 in electrical contact with the prongs 18 to connect the LED 16 to the leads 21. The electrical contact is achieved because the prongs, typically of metal, can conduct electricity from the leads 21 to the LED 16. In these illustrated embodiments it is desirable to insulate the body of the supports except for areas 24.

In the embodiment of FIG. 1 the prongs 18 are attached to each other but insulated from each other and the LED 16, is connected to each prong 18 to complete a circuit. Thus, there is a constant light while power is maintained.

In the embodiment of FIGS. 2 and 3 the prongs 18 are spaced apart from each other with the illuminated means 16 attached between the outer ends to complete the circuit. Again a constant illumination is provided while power is maintained.

It is desirable that the illumination means can flash. Light emitting diodes that can flash are cheaply and easily available and a flashing light offers greater means of attracting attention. In addition to the LED 16 shown in FIG. 1 an incandescent bulb can be used.

A power source is required and can be either a connection to the normal power supply of a building, for which the embodiment of FIGS. 2 and 3 is apt, or it can be a battery pack, easily affixed to the back or front of a perforate board, a photovoltaic cell, which is particularly desirable for ease of use and maintenance. The power source may be intermittent to allow flashing of the illumination means.

Figure 6:
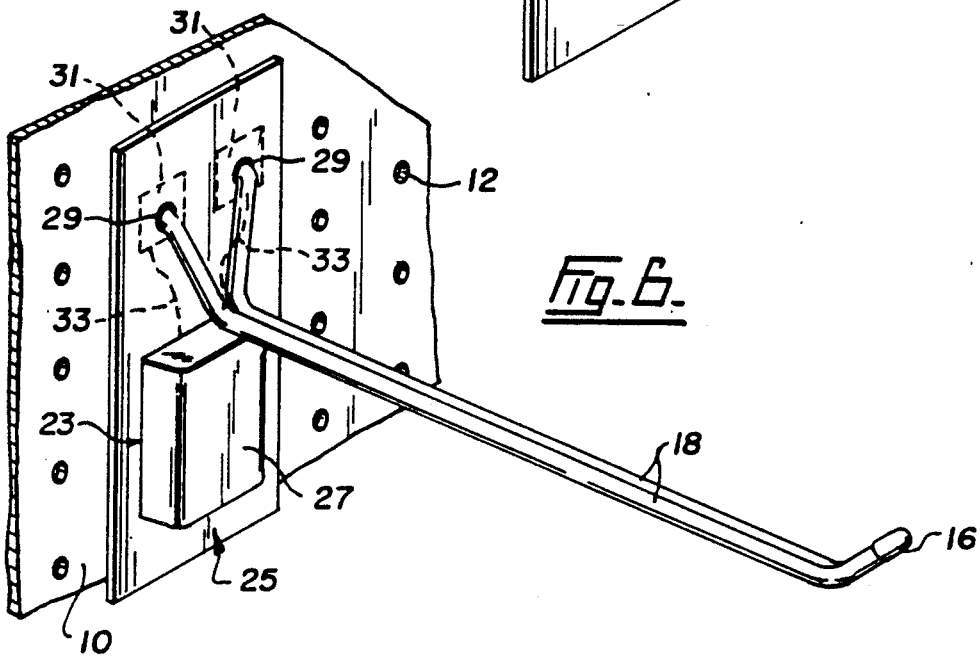

FIG. 6 shows a battery pack 23. The battery pack comprises a carrier 25 to which is attached a source of power 27 in the form of a dry cell, or photovoltaic cell 27 or the like. There are openings 29 in the carrier 25 surrounding conductors 31. Leads 33 extend from the power source 27 to the conductors 31. There are uncoated conducting portions 24 on the prongs 18 to engage the conductors. The carrier 25 can be mounted on the front or the back of the board 10. The arrangement is simple. The prongs 18 contact the conductors 31 and also act to locate the support in the openings 12 of the board 10. The LED 16, 36 and 46 is thus powered by the power source 27.

The apparatus in FIGS. 1 to 6 operate by providing either a constant illumination of a display of packages located on the prongs 18 or can be used to flash to attract attention to the packages.

Figure 7:
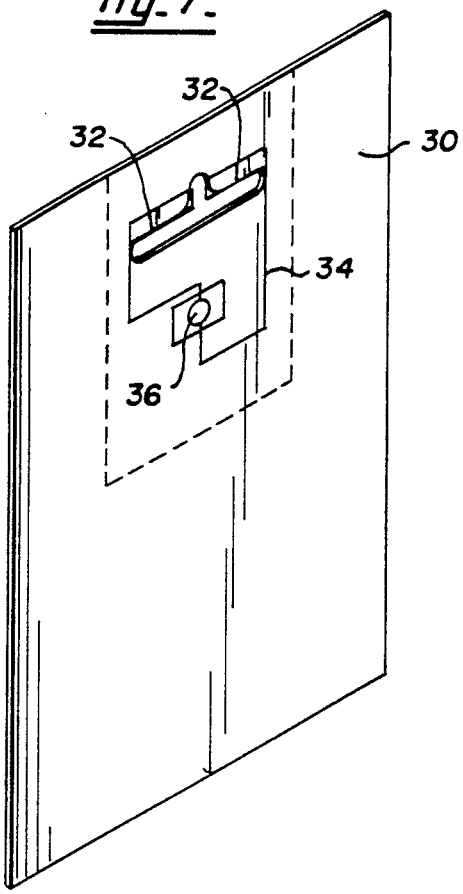
FIG. 7 illustrates the FIG. 9 embodiment in use on a card carrying goods to be sold.
Figure 8:
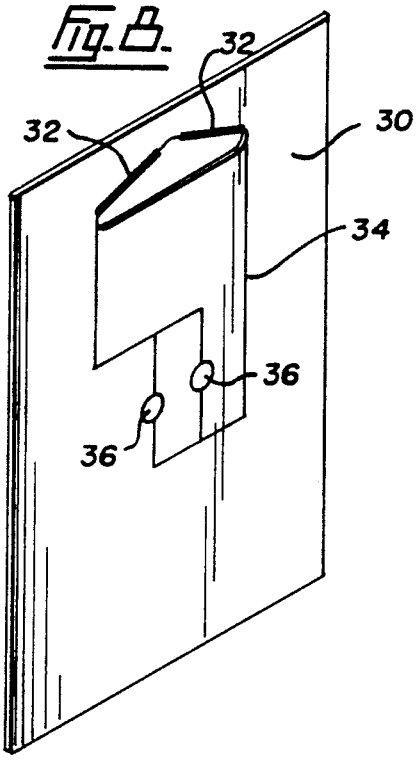
FIG. 8 illustrates a further embodiment.

FIGS. 7 and 8 illustrate an illuminated display that comprises a base 30 received on electrically conducting prongs 18 as shown in FIGS. 1, 2 and 3. As shown in FIGS. 2 and 3, the prongs 18 are spaced apart and there are non-insulated areas 24 adjacent the outer and inner ends. As described above the arrangement is such that a package can slip to the lower ends, down the slope of the prongs 18 to make contact with areas 24.

In FIGS. 7 and 8 the base 30 has a pair of contacts 32, one to make electrical contact with an area 24 of an electrically conducting prong 18. The prongs 18 are insulated until areas 24 adjacent their outer and inner ends. There is a circuit 34 formed on the base 30 and a LED 36 on the base 30 in electrical contact with the circuit 34. The arrangement is such that completion of the circuit by the pair of contacts 32 contacting the live portions 24 of the prongs 18 lights the LED.

As shown particularly in FIGS. 7 and 8, the base 30 is a card to which is attached the wares to be sold, as shown in FIG. 4. The card is desirably translucent, or perforated, particularly if the LED is to be mounted on the back of the card, remote from the wares. Translucency or perforation for the LED means that the illumination can then be seen at the front of the card.

Figure 9:
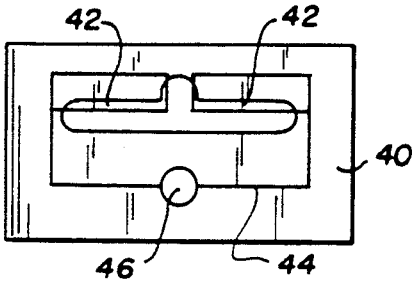
FIG. 9 illustrates yet a further embodiment.
Figure 10:
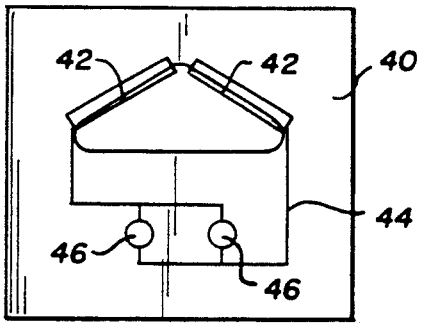
FIG. 10 illustrates a variation of FIG. 9.

In the embodiment of FIGS. 9 and 10 the base 40 is a small transparent sheet, which may simply be adhered to a card, for example on an area of a larger base, as shown by the broken line in FIGS. 5 or 7. Desirably the circuit is a printed circuit due to the ease with which such circuits now can be formed. This embodiment resembles closely that of FIGS. 7 and 8 but the base involved is smaller in the embodiment of FIGS. 9 and 10. The base 40 has contact 42 to make contact with areas 24 of prongs 18. There is a circuit 44 formed on base 40 and an LED 46 (FIG. 9) or two (FIG. 10) is or are attached to base 40 in contact with the circuit 44.

With the invention a package may be illuminated by a LED or the like that forms part of the support as shown in FIGS. 1 to 4 or may be illuminated by a LED on a backing card for the package as shown in FIGS. 7 and 8 or by a LED mounted on a separate base adhered to a backing card as in FIGS. 9 and 10.

Both forms of illumination may be used for one package.

We claim:

1. An illumination display for mounting to a support surface comprising, in combination:

a base for supporting wares to be sold, the base being removably received on a pair of electrically conducting members;

said support surface comprising a perforate board and said electrically conducting members comprise a pair of prongs adapted to be received on said perforate board to extend outwardly, downwardly from said board and shaped at one end to be located in the perforations in said board;

a pair of contacts on the base, one to make electrical contact with each electrically conducting member;

a circuit formed on the base;

illumination means on the base in electrical contact with the circuit, whereby completion of the circuit by the pair of contacts lights the illumination means.

2. A display as claimed in claim 1 including a non-conducting member attached to the prongs to abut the board, the electrically conducting members extending through the non-conducting member to be connected with the prongs as a means of connecting the prongs with a source of electricity.

3. A display as claimed in claim 1 in which the electrically conducting members have electrical contact areas located adjacent both ends.

4. A display as claimed in claim 1 in which the illumination means can flash.

5. A display as claimed in claim 4 in which the illumination means is a light emitting diode (LED).

6. A display as claimed in claim 1 including a power source.

7. A display as claimed in claim 6 in which the power source is a battery pack.

8. A display as claimed in claim 6 in which the power source is a photovoltaic cell.

9. A display as claimed in claim 6 in which the power source is intermittent to allow flashing of the illumination means.

10. A display as claimed in claim 1 in which the base is translucent.

11. A display as claimed in claim 1 in which the base is a transparent sheet to be mounted on a card carrying wares.

12. A display as claimed in claim 1 in which the circuit is a printed circuit.

13. A display as claimed in claim 1 in which the illumination mean is an LED.

* * * * *